US005927228A

United States Patent [19]

Richard et al.

[11] Patent Number: 5,927,228

[45] Date of Patent: Jul. 27, 1999

[54] SELF-RIGHTING INFLATABLE LIFE-RAFT

[75] Inventors: Alain Richard, Montendre; Marc Lavorata, Paris, both of France

[73] Assignee: Zodiac International, Issy les Moulineaux, France

[21] Appl. No.: 08/991,806

[22] Filed: Dec. 16, 1997

[30] Foreign Application Priority Data

Dec. 18, 1996 [FR] France ..... 96 15563

[51] Int. Cl.[6] ..... B63B 7/00

[52] U.S. Cl. ..... 114/345; 441/40

[58] Field of Search ..... 114/345, 348, 114/349; 441/38, 40, 35, 37, 39, 42

[56] References Cited

U.S. PATENT DOCUMENTS

| | | | |
|---|---|---|---|
| 3,092,854 | 6/1963 | Manhart | 441/38 |
| 4,180,882 | 1/1980 | Kawasaki . | |
| 4,573,933 | 3/1986 | Cameron . | |
| 4,998,900 | 3/1991 | Wright . | |

FOREIGN PATENT DOCUMENTS

| | | |
|---|---|---|
| 1146076 | 11/1957 | France . |
| 2532907 | 3/1984 | France . |
| 1379640 | 1/1975 | United Kingdom . |
| 2171364 | 8/1986 | United Kingdom . |

*Primary Examiner*—Ed L. Swinehart

*Attorney, Agent, or Firm*—Dean W. Russell; Kilpatrick Stockton LLP

[57] ABSTRACT

Self-righting inflatable life-raft (1) comprising a peripheral edge (2) consisting of at least one inflatable tubular chamber surrounding a bottom (3) secured in leaktight fashion to the said tubular chamber, at least one inflatable tubular hoop (4) extending above the raft between two opposite sides of the inflatable tubular chamber (2); at least two more or less parallel hoops (4) are provided; each hoop (4) is equipped with a reserve of gas (8) projecting from the outside of the hoop (4) and in a region thereof which is at an angle ($\alpha$) of approximately 30 to 60° above the horizontal, the assembly formed by the hoop (4) and the reserve (8) being asymmetric with respect to the vertical mid-plane (5) of the raft; and a heavy weight (6, 7) is secured to the raft along that one of its edges that is on the same side as the abovementioned reserves (8).

13 Claims, 5 Drawing Sheets

SELF-RIGHTING INFLATABLE LIFE-RAFT

FIELD OF THE INVENTION

The present invention relates to improvements made to self-righting inflatable life-rafts comprising a peripheral edge consisting of at least one inflatable tubular chamber surrounding a bottom secured in leaktight fashion to the said tubular chamber, at least one inflatable tubular hoop extending above the raft between two opposite sides of the inflatable tubular chamber.

BACKGROUND OF THE INVENTION

Various embodiments of life-raft laid out in this way are already known (see, for example, documents U.S. Pat. No. 4,998,900, FR 2,467,770, GB 2,060,509).

However, in these known structures, the hoops, of which there are two, extend in secant vertical planes and form a cupola shape over the raft. A layout of this kind is suitable only for rafts which have a fairly compact shape (with an outline that is square, polygonal—especially hexagonal or octagonal—, rectangular with not much elongation, circular) and are of a relatively small size. It is not suitable for rafts of elongate shape, especially for rafts of very large size (high- or extremely high-capacity rafts taking, for example, 50, 100 or 150 people) which are currently needed for fitting out vessels (such as cruise liners, car ferries) from which passengers need to be able to be evacuated extremely fast: on the one hand, the cupola layout of the secant hoops cannot be applied to large-sized rafts and, what is more, if a layout of this kind were to be associated with an elongate shape (rectangular overall) of the raft, two "dead" positions would be defined, from which the raft, laying on its side or especially on an end, would not be able to tip right over.

SUMMARY OF THE INVENTION

The object of the invention is essentially to overcome the aforementioned drawbacks of the known structures and to provide an improved solution which offers guaranteed righting of the raft from an overturned starting position, and which can be applied and is effective irrespective of the size and shape of the raft, including in the case of elongate and/or high-capacity rafts.

Thus, a self-righting life-raft as mentioned in the preamble and laid out in accordance with the invention is essentially characterized by the following combination of features:

- at least two more or less parallel hoops are provided,
- each hoop is equipped with a reserve of gas projecting from the outside of the hoop and in a region thereof which is at an angle ($\alpha$) of approximately 30 to 60° above the horizontal, the assembly formed by the hoop and the reserve being asymmetric with respect to the vertical mid-plane of the raft, and
- a heavy weight is secured to the raft along that one of its edges that is on the same side as the abovementioned reserves.

The layout with two parallel hoops means that the raft, initially upside down, can very definitely be brought into an intermediate position from which it can be guaranteed that it can be tipped right over. The reserve provided on the hoop, in conjunction with the peripheral tubular chamber, defines a surface for resting on the water which is such that the raft lying on its side lies approximately vertically, or is even inclined slightly beyond the vertical which means that in conjunction with the action of the heavy weight that is present on the same side of the raft, the raft can very definitely be tipped right back into its righted normal position. At worst, in particularly unfavourable circumstances, especially in an opposing wind which hampers the tipping-over of the raft, somebody in the water can, by grabbing hold of the raft, manage all by themselves to complete the tipping operation without any difficulty.

In a first possible embodiment, the reserve consists of at least one pocket attached to the outside of the hoop. In another possible embodiment, the reserve consists of a portion of the hoop, which portion is deformed and offset outwards with respect to the corresponding foot of the hoop, the said hoop being asymmetric with respect to the vertical central plane of the raft.

Advantageously, the heavy weight includes equipment for inflating the raft, especially situated on the outside under the raft in the immediate vicinity of the outer edge of the raft, and/or the heavy weight includes gear and/or survival gear with which the raft is equipped, situated inside the raft along the internal edge of the inflatable tubular chamber.

To reinforce the raft, there may be provided at least one reinforcing crossmember consisting of an inflatable tubular chamber extending inside the raft along the bottom and between two opposite sides of the inflatable edge to which it is secured.

In a particular layout, it may be ensured that the respective feet of the hoops are situated inside the inflatable tubular chamber of the peripheral edge and extend approximately as far as the aforementioned bottom.

A preferred embodiment of the life-raft of the invention consists in combining the previous two features and in ensuring that there are as many crossmembers as there are hoops and that these each extend between the opposite feet of a hoop to which they are secured, so that the hoops and the crossmembers together form rings that stiffen the raft.

When the raft is of elongate shape, it is easy to ensure that it has more than two hoops spread out along the length of the raft, particularly at approximately uniform distances apart.

BRIEF DESCRIPTION OF THE DRAWINGS

A better understanding of the invention will be gained on reading the detailed description which follows of a number of preferred embodiments which are given simply by way of illustration. In this description, reference is made to the appended drawings in which.

DETAILED DESCRIPTION

Figure 1:
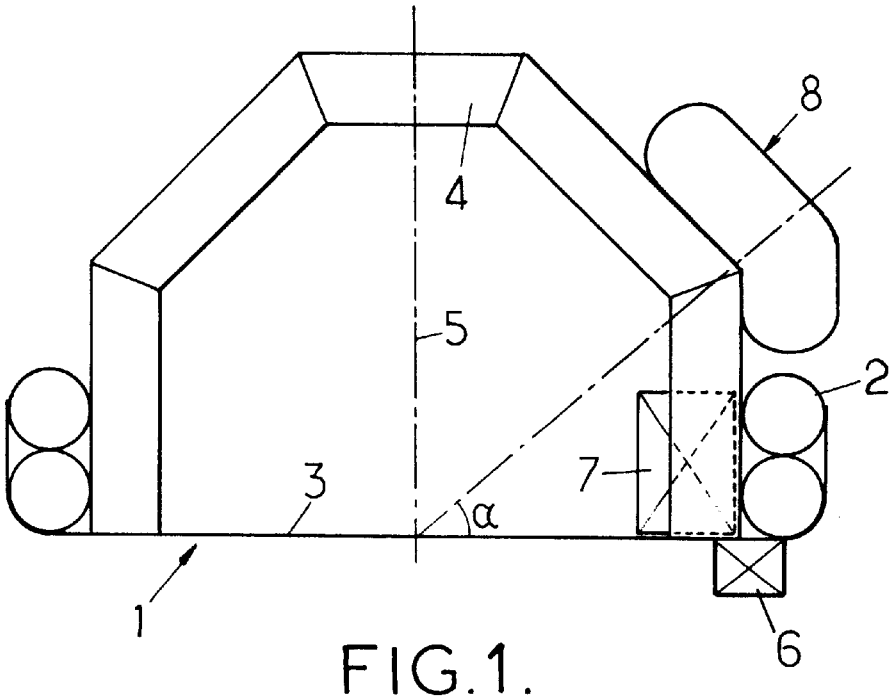
FIG. 1 is a highly diagrammatic view in cross section illustrating a first embodiment of a self-righting life-raft laid out in accordance with the invention.

Referring first of all to FIG. 1, this depicts very diagrammatically and in cross section a first embodiment of a life-raft laid out in accordance with the invention. The life-raft, denoted overall by the reference 1, essentially comprises a peripheral edge 2 made in any desirable way of at least one tubular inflatable buoyancy chamber (in particular, either a single large tubular chamber or a number—especially two or three—superimposed tubular chambers). The edge 2 surrounds a central bottom 3 secured to it in leaktight fashion around its periphery. The precise layout of the raft is not important and has no bearing on the scope of the present invention.

Above the raft there are at least two hoops 4 more or less parallel to one another, the number of which is appropriate to the length of the raft. Each hoop 4 consists of a curved inflatable tubular chamber or one made of straight sections butted together as shown in FIG. 1, which extends from a region of the peripheral edge 2 as far as an opposite region of the said edge. When the raft is of elongate shape, the hoops run more or less transversely to the longitudinal mid-plane 5 of the raft.

If, as the raft enters the water and inflates, it is upside down, the presence of the inflating hoops, which are spread out along its entire length and prevent the raft from being able to find a stable upside-down position, causes the raft to tip over onto its side.

For this position of lying on its side to be an unstable position and for the raft to be forced to continue to tip over so that it comes into the water in the correct position, it is appropriate for the centre of buoyancy and the centre of gravity of the raft to be in mutual positions which are such that they generate a turning moment. To achieve this, the invention combines two features:

- each hoop 4 is equipped with a reserve of gas projecting from an outer side of the hoop and in a region thereof which is at an angle $\alpha$ of approximately 30° to 60° above the horizontal, the inflated assembly formed by the hoop and the said reserve being asymmetric with respect to the vertical mid-plane 5 of the raft;
- a heavy weight is secured to the raft along that one of its edges that is on the same side as the abovementioned reserves; in practice, the heavy weight may, as shown in FIG. 1, consist on the one hand of the equipment 6 for inflating the raft, which equipment is situated under the raft as close as possible to the outside edge and, on the other hand, of the gear or possibly survival gear, denoted by the reference 7, situated inside the raft right up against the edge surmounted by the aforementioned gas reserves 8.

Figure 1A:
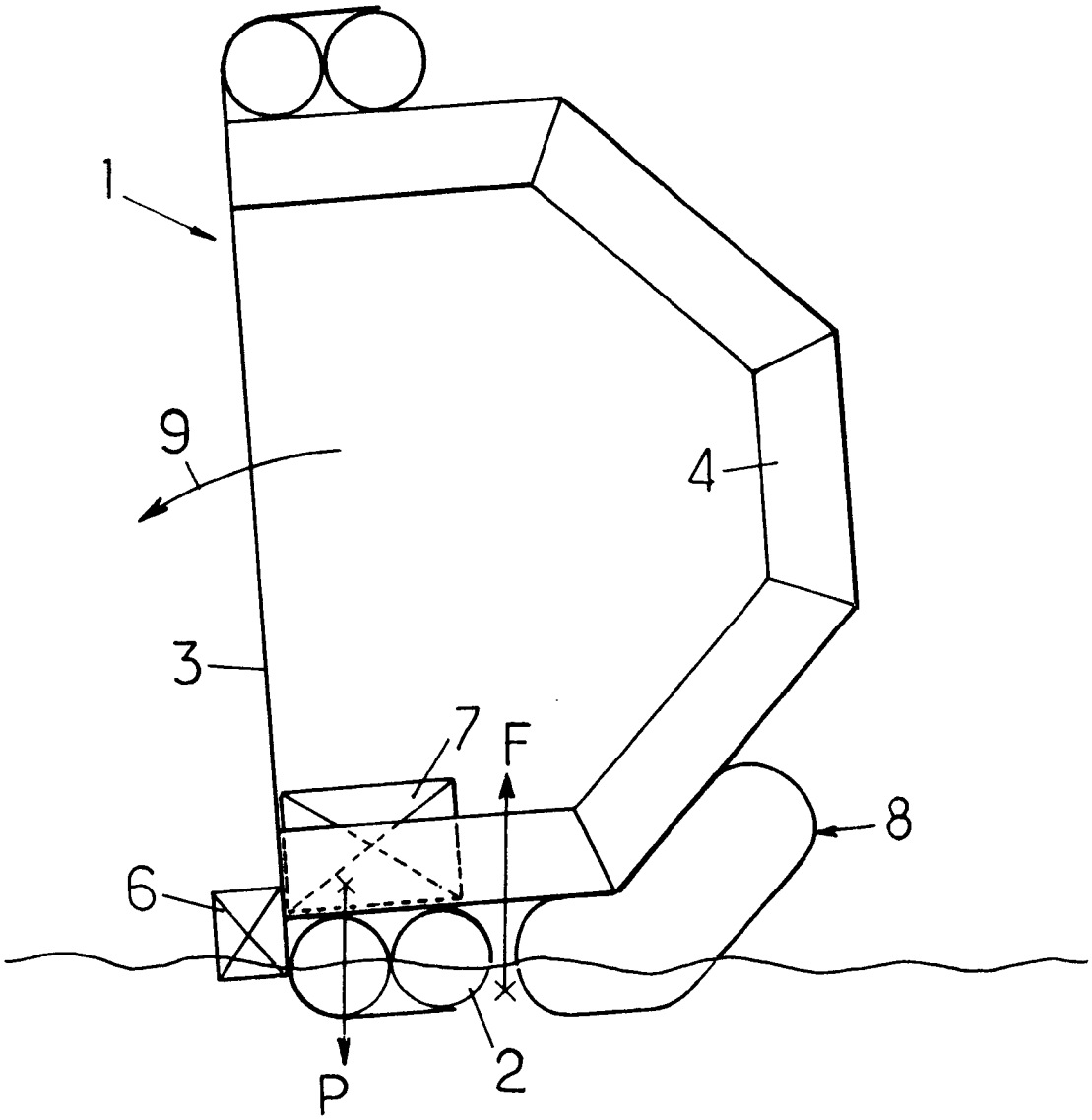
FIG. 1A is a highly diagrammatic view showing the raft of FIG. 1 in a position in which it is lying on its side in the process of being righted.

In FIG. 1A, the raft of FIG. 1 has been depicted in a position lying on its side, fully inflated including the reserves 8, and we have shown, approximately, the position of the centre of buoyancy with the upthrust F, which is vertical and directed upwards, and the position of the centre of gravity with the weight P, vertical and directed downwards, the centre of gravity being offset towards the bottom of the raft and higher up than the centre of buoyancy. The two forces F and P thus arranged generate a moment which tends to make the raft tip (to the left in FIG. 1A: arrow 9) and bring it into the correct position on the water.

In the embodiment more specifically depicted in FIGS. 1 and 1A, each reserve 8 consists of a pocket attached to an outer side of the hoop 4, the pocket 8 preferably being in communication with the hoop 4 so that it can inflate at the same time as the latter.

Figure 2:
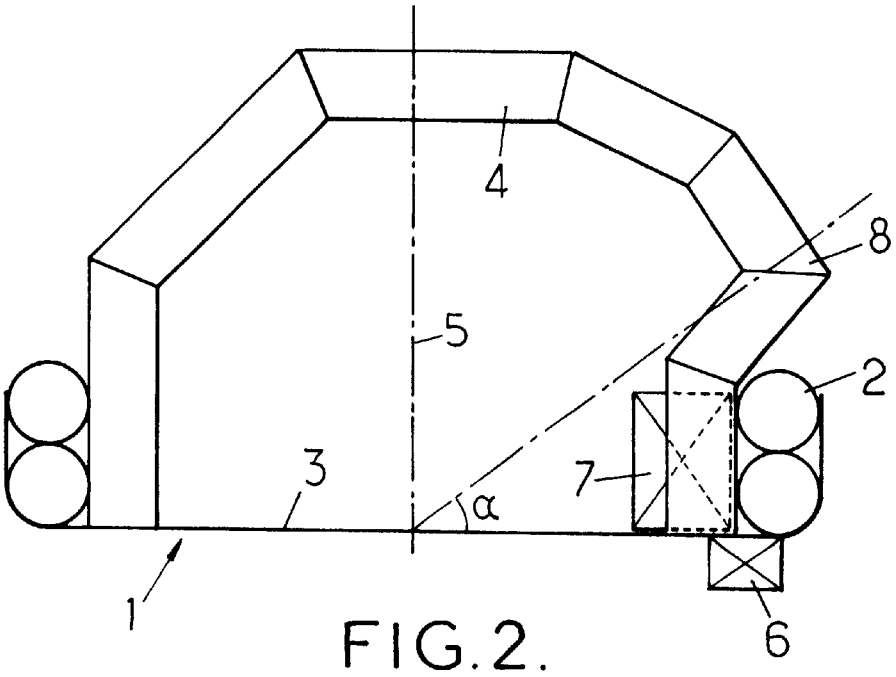
FIG. 2 is a highly diagrammatic view in cross section illustrating a second embodiment of a self-righting life-raft laid out in accordance with the invention.

In the embodiment of FIG. 2, the raft is laid out, overall, in the same way as in FIG. 1, the only difference being that the reserve 8 consists of an outward deformation of the hoop 4 itself: thus, the hoop 4 is no longer symmetric with respect to the mid-plane 5, but is laid out so that when inflated it projects outwards overhanging the peripheral tubular chamber 2.

It may be desirable for each reserve 8, irrespective of their design and shape, to extend outwards appreciably beyond the external outline of the inflatable tubular chamber 2 so that when the raft is in the position lying on its side as illustrated in FIG. 1A, the bottom 3 does not extend vertically above the surface of the water, but is slightly inclined (to the left in FIG. 1A): this feature, which combines with the mutual offset between the centre of gravity and the centre of buoyancy, makes the final tipping-over of the raft easier and quicker.

Figure 3:
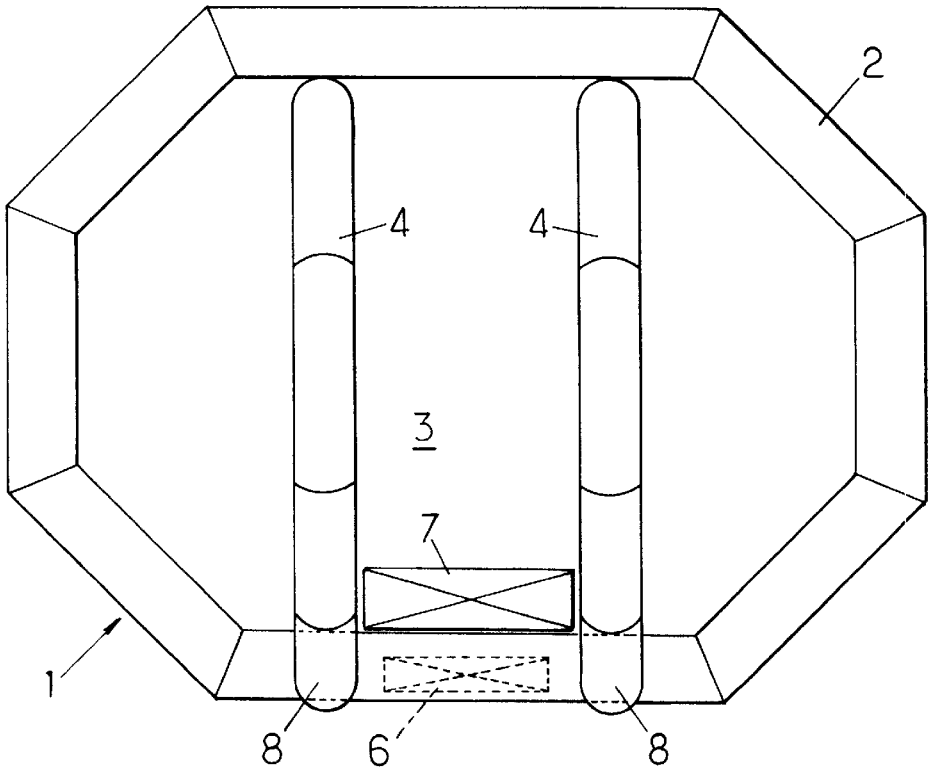
FIG. 3 is a highly diagrammatic view in cross section illustrating an alternative form of the embodiments of FIGS. 1 and 2.

To give a better understanding of the layout in accordance with the invention, FIG. 3 illustrates a schematic view of the top of the raft of FIGS. 1 and 2.

Figure 4:
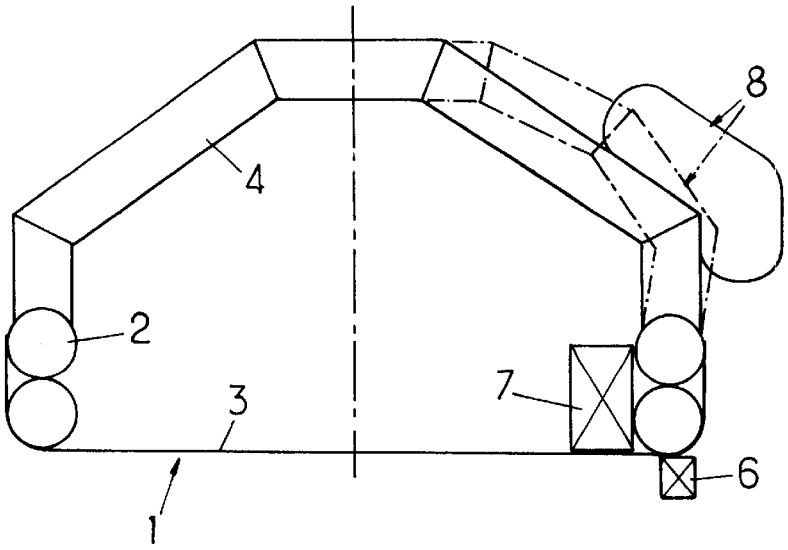
FIG. 4 is a diagrammatic view from above which corresponds to the embodiments of FIGS. 1 and 2.

In FIGS. 1, 1A, 2 and 3, the hoops 4 have been depicted with their feet inside the peripheral tubular chamber 2 and extending approximately as far as the bottom 3. Although such a layout may have a particular advantage that will become clear later, it is not, however, the only one, and other configurations may be envisaged within the scope of the invention. As an example, FIG. 4 illustrates another embodiment in which the hoops rest directly on the back of the top of the peripheral tubular chamber 2, the raft in all other respects being identical to the one described earlier and shown in FIGS. 1 and 1A (in solid line) and in FIG. 2 (in broken line).

Figure 5:
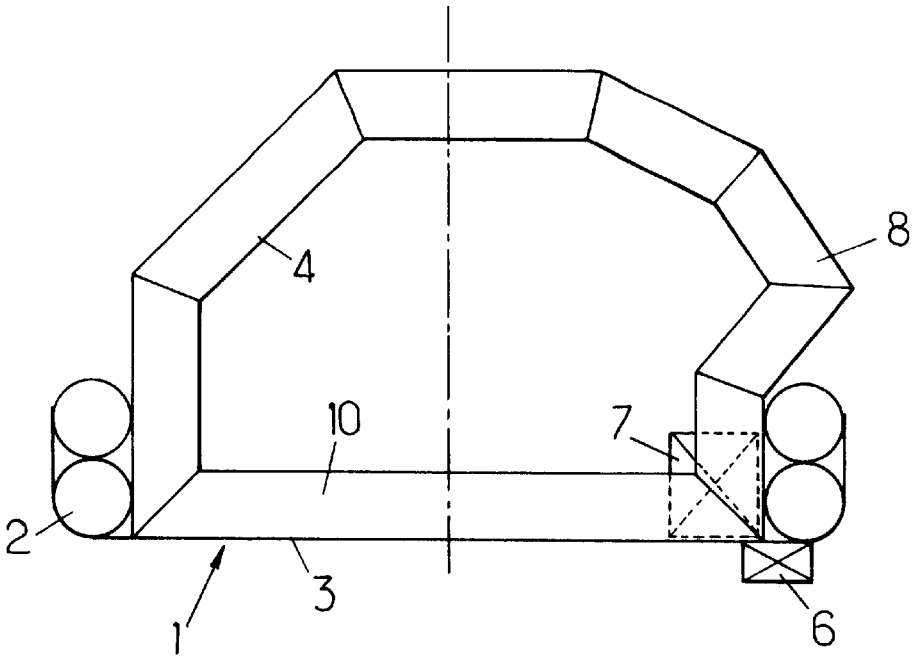
FIG. 5 is a highly diagrammatic view in cross section illustrating a preferred embodiment of the layout shown in FIG. 2.

It is desirable, particularly as far as high-capacity and therefore large-sized rafts are concerned, for one or more reinforcing crossmembers 10 consisting of an inflatable tubular chamber extending inside the raft along the bottom 3 and between two opposite sides of the inflatable edge 2 to which they are secured to be provided. A layout of this kind is illustrated in FIG. 5, in a raft configuration identical to that of FIG. 2. It is then beneficial to have a number of crossmembers 10 corresponding with the hoops 4, these crossmembers running between the respective opposite feet of each hoop 4 and being secured to them and in communication with them. This then forms rings (polygonal ones in the case illustrated in FIG. 5) which stiffen the raft.

Figure 6:
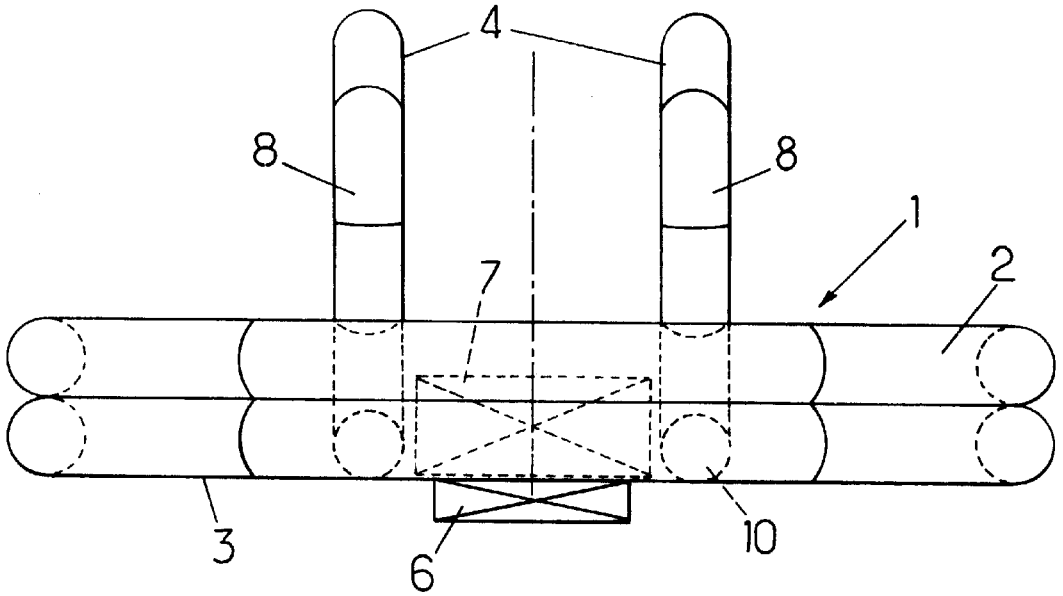
FIG. 6 is a highly diagrammatic side view of the preferred embodiment of FIG. 5.

FIG. 6 is a diagrammatic side view drawn to correspond with FIG. 5.

Figure 7:
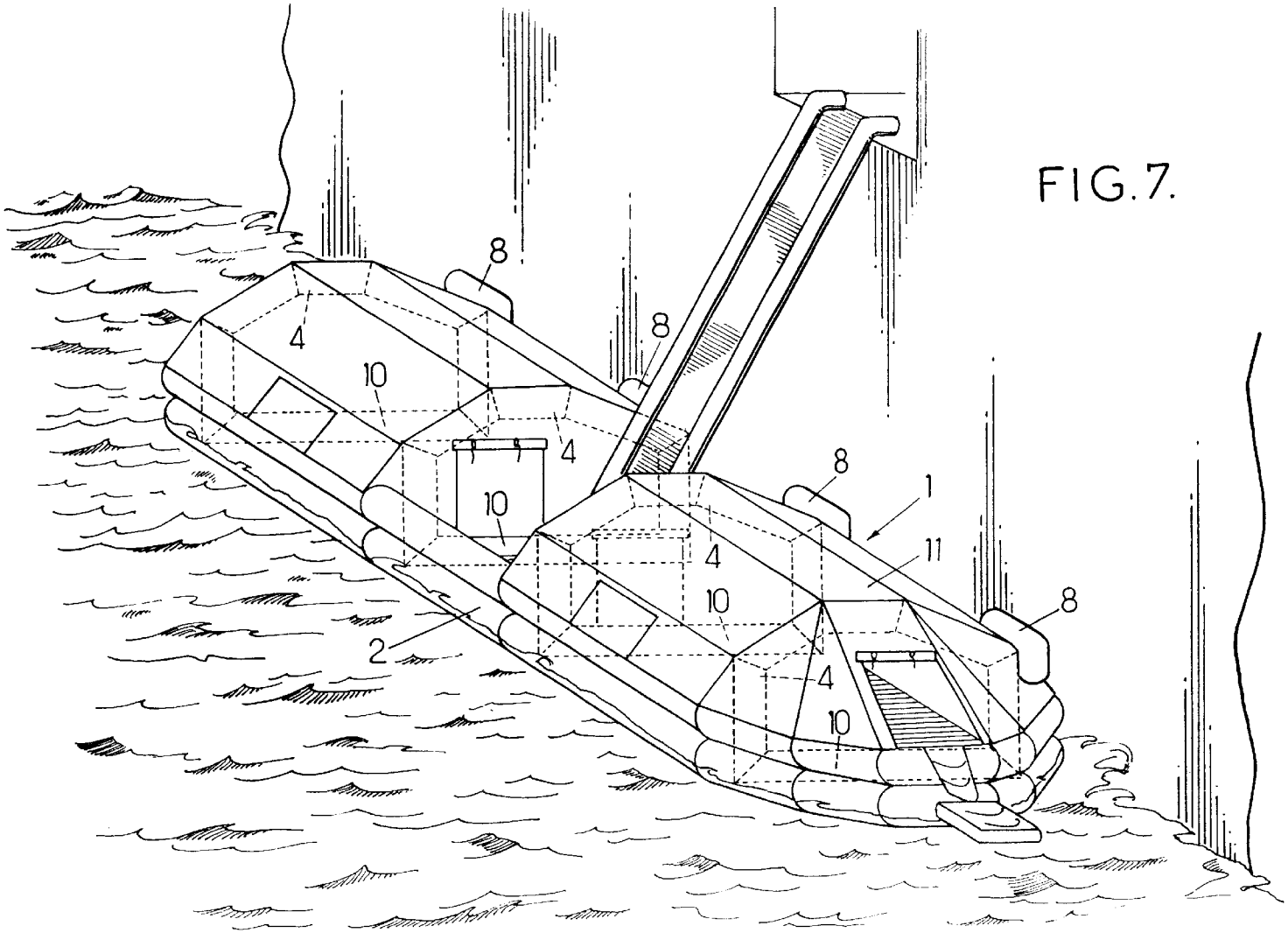
FIG. 7 is a perspective view showing a life-raft according to the invention in a position of people shipping.

To give a better overall idea, FIG. 7 is a perspective view showing, in its situation, a high-capacity raft 1 (for example for about 100 people) laid out in accordance with the invention. This raft, which is of elongate shape, is designed with the features shown in FIG. 1 and has four hoops 4, with corresponding crossmembers 10, spread out along the length of the raft and also acting as supports for two shelters 11. The pockets 8 are arranged on the outside on the corner formed by each hoop.

Needless to say and as is already obvious from the foregoing, the invention is not in any way restricted to the applications and embodiments more specifically envisaged; on the contrary, it encompasses all alternative forms thereof.

We claim:

1. Self-righting inflatable life-raft defining a peripheral edge and comprising at least one inflatable tubular chamber surrounding a bottom secured in leaktight fashion to the tubular chamber, at least two generally parallel inflatable hoops extending above the raft between two opposite sides of the inflatable tubular chamber, said two opposite sides extending apart from a vertical mid-plane of the raft respectively on both sides thereof, each hoop being adapted, on one side of the raft, so as to include a part containing a reserve of gas projecting laterally outward in a region located at an angle of approximately 30 to 60° above the horizontal from an intersection of the vertical mid-plane of the raft with the bottom, the hoop so including the projecting part being asymmetric with respect to the vertical mid-plane of the raft, and a heavy weight secured to the raft on the same side as the projecting parts.

2. Life-raft according to claim 1, in which at least one projecting part comprises at least one pocket on the outside of at least one hoop.

3. Life-raft according to claim 1, in which each hoop has two opposite feet resting on the raft and at least one projecting part is provided by the hoop being offset outward with respect to a respective foot thereof resting on the raft.

4. Life-raft according to claim 1, in which the heavy weight includes equipment for inflating the raft, especially situated on the outside under the raft in the immediate vicinity of the outer edge of the raft.

5. Life-raft according to claim 1, in which the heavy weight includes gear with which the raft is equipped, situated inside the raft along the internal edge of the inflatable tubular chamber.

6. Life-raft according to claim 1, further comprising at least one reinforcing crossmember including an inflatable tubular chamber extending inside the raft along the bottom and between two opposite sides of the inflatable edge to which it is secured.

7. Life-raft according to claim 1, in which at least one hoop defines two opposite feet which are situated inside the inflatable tubular chamber of the peripheral edge and extend approximately as far as the bottom.

8. Life-raft according to claim 6, in which each hoop has two opposite feet, and comprising as many crossmembers as there are hoops, each crossmember extending between the opposite feet of a hoop to which it is secured, so that the hoops and the crossmembers together form rings that stiffen the raft.

9. Life-raft according to claim 1 of high capacity and appreciably elongate shape and having more than two hoops, which are spread out along the length of the raft at approximately uniform distances apart.

10. Life-raft according to claim 1, in which each hoop is made up of generally straight sections joined together one after another with an open polygonal outline.

11. Life-raft according to claim 1, in which the hoops hold up at least one canvas for defining at least one shelter for those on board.

12. Life-raft according to claim 7 in which there are as many crossmembers as there are hoops and that each crossmember extends between the opposite feet of the hoop to which it is secured, so that the hoops and the crossmembers together form rings that stiffen the raft.

13. An inflatable life-raft defining a vertical mid-plane and comprising:

a. a bottom having opposed first and second sides extending apart from the vertical mid-plane respectively on both sides thereof;

b. at least one inflatable chamber secured to and surrounding the bottom;

c. a plurality of inflatable hoop assemblies extending above the inflatable chamber and between the opposed first and second sides of the bottom, at least one of such hoop assemblies including a laterally-outward projecting portion housing a reserve of gas, such hoop assembly including the laterally-outward projecting portion being asymmetric with respect to the vertical mid-plane of the raft with the laterally outward projecting portion being closer to the first side of the bottom than the second side of the bottom; and d. a weight positioned so as to be closer to the first side of the bottom than the second side of the bottom.

* * * * *